US005199173A

United States Patent [19]

Hegemann et al.

[11] Patent Number: 5,199,173

[45] Date of Patent: Apr. 6, 1993

[54] CONCAVE, CONVEX SAFETY RAZOR

[75] Inventors: Kenneth J. Hegemann; Rebecca M. Inzunza, both of Carlsbad, Calif.

[73] Assignee: Hegemann Research Corporation, Carlsbad, Calif.

[21] Appl. No.: 779,065

[22] Filed: Oct. 17, 1991

[51] Int. Cl.[5] ..... B26B 21/00; B26B 21/08; B26B 21/14; B26B 21/16

[52] U.S. Cl. ..... 30/49; 30/51; 30/85; 30/89

[58] Field of Search ..... 30/47, 49, 50, 52, 89, 30/302, 329, 356, 51, 85

[56] References Cited

U.S. PATENT DOCUMENTS

| | | | |
|---|---|---|---|
| 672,983 | 4/1901 | Kampfe et al. | 30/89 |
| 1,040,347 | 10/1912 | Kampfe | 30/51 |
| 1,742,330 | 1/1930 | Valet | 30/85 |
| 1,821,825 | 9/1931 | Zumwalt | 30/49 |
| 3,938,250 | 2/1976 | Perry | 30/50 |
| 4,411,065 | 10/1983 | Trotta | 30/47 |
| 4,459,744 | 7/1984 | Esnard | 30/49 |
| 4,980,974 | 1/1991 | Radcliffe | 30/50 |
| 4,993,154 | 2/1991 | Radcliffe | 30/49 |

FOREIGN PATENT DOCUMENTS

| | | | |
|---|---|---|---|
| 426651 | 4/1935 | Fed. Rep. of Germany | 30/49 |

*Primary Examiner*—Douglas D. Watts
*Assistant Examiner*—Paul M. Heyrana, Sr.
*Attorney, Agent, or Firm*—Stanley A. Becker

[57] ABSTRACT

A safety razor which conforms to both concave and convex body surfaces and has a handle and a curved rotatable cartridge. Shaving blades are positioned on both sides of the curved cartridge, thus, both concave and convex accurate cutting edges are obtained in a single compact cartridge. The concave surface is used when shaving convex body surfaces. Rotating the cartridge 180 degrees exposes the convex cutting surface for shaving concave body surfaces. The cartridge is rotatably mounted to the handle and is held in either concave or convex shaving positions with detents. When the alternate shaving position is desired, the cartridge is rotated 180 degrees, either manually or remotely using a push button device within the handle, which is also disclosed. The correct angular relationship of the handle to the cutting surface of the cartridge is set and maintained for both concave and convex settings by means of the detents since the amount of rotation between the two shaving settings is 180 degrees.

26 Claims, 6 Drawing Sheets

CONCAVE, CONVEX SAFETY RAZOR

BACKGROUND OF THE INVENTION

1. Field of the Invention

The present invention generally concerns wet shaving systems, more specifically, hand-held razors having both concave and convex cutting surfaces in order to optimize shaving of various body contours.

2. Background Of The Invention

Typically, safety razors have one or more blades, each having one or more sharp edges, supported in a flat razor head assembly between a lower guard bar and seat combination and cap member. The guard bar and cap members cover virtually the entire surface of the blade with the exception of the cutting edges which are left exposed, slightly behind the guard bar. The guard bar is configured and angled, and the blade is positioned in relation thereto, so as to provide a preferred angle between the blade and surface to be shaved when the assembly is drawn over the shaving surface.

Razors of this type work satisfactorily on planar shaving surfaces. The human body, however, has few if any planar surfaces, thus, razor blades are virtually always drawn over a curved surface, particularly in the chin and neck areas of men and the legs and underarms of women. In these areas, a planar blade is an inefficient cutting instrument requiring repeated strokes in order to effectively remove hair. In such conventional razors, the razor head cannot properly conform to curved shaving surfaces because the cap and guard members are made of relatively stiff metal or plastic, particularly when arranged in a sandwich configuration with the blade.

Numerous patents have recognized the desirability of having curved blades which conform to curved shaving surfaces. For example, see Zumwalt, U.S. Pat. No. 1,821,825 which discloses a razor that has a flexible blade that can be installed in either a convex or concave position. Similarly, Ohmer, U.S. Pat. No. 2,008,591, discloses a razor having a flexible blade that may be held in either a convex or concave position. In both patents, the razor must be disassembled to switch from convex to concave cutting surfaces.

Van Cleve, U.S. Pat. No. 4,208,791, discloses a razor cartridge that is shaped to conform to both concave and convex body portions. On one side is a cutting surface in a concave position, while the other side has a cutting edge shaped in a convex position. The user rotates the handle to go from the concave to the convex position. However, the razor is designed for shaving only the legs and underarms and consequently the blades are not at the angle which shavers have become accustomed to in shaving the face and neck.

Recent efforts have been directed toward enhancing the spanwise flexibility of razors for curved surface shaving using various razor head configurations. U.S. Pat. No. 4,854,043, issued to Chen, proposes a flexible razor head, claiming a blade cartridge stiffness wherein 45–90 grams of load produces a spanwise deflection of 0.50 inches. Any such flexible razor requires significant forces delivered by the user in order to achieve cartridge conformity to curved body surfaces. Additionally, as the extent of body curvature increases, the amount of force required to flex the cartridge must also increase in order to conform it to the curvature of the body surface being shaved. Use of such forces to achieve adequate blade curvature often results in cuts or nicks in the surface being shaved.

Some other patents that disclose razors having flexible blades that can be moved into curved cutting positions, include those of Stover, U.S. Pat. No. 2,582,176, and Radcliffe, U.S. Pat. Nos. 4,942,662 and 4,993,154. U.S. Pat. No. 4,459,744, issued to Esnard, discloses a razor that flexes between concave and convex shapes in correspondence with the surface to be shaved and by the force applied thereto. Such razors typically are not able to maintain precise cutting edge geometry due to the flexing of the blade and cartridge.

There are several disadvantages associated with flexible shaving razors. First, the user must become familiar with new shaving techniques and apply additional forces in order to obtain flexure of the cartridge. Any additional force against the skin beyond that required when using a conventional flat razor, can result in skin irritation and accidental shaving nicks.

Second, precise blade cutting edge geometry (the angle and distance relationship between the blade cutting edge and the leading guard or so called soap bar), is very important in achieving a close, comfortable shave. This precise geometry is very difficult to maintain through the parameters of flexure of flexible shaving cartridges, and can result in additional accidental shaving nicks.

Having examined the disadvantages of both conventional flat blade cartridges and flexible safety razors, it is not surprising that the prior art is laden with various proposals which address the body curvature problem from a different approach. Many designers have recognized the need for a safety razor with a built-in curved cutting edge which reasonably matches body curvature. However, none of the references cited disclose a cartridge having a fixed concave blade on one side and a fixed convex blade on the other, which is selectively rotatable into either position.

SUMMARY OF THE INVENTION

The present invention fills the above-stated need by providing a user-selectable convex/concave mode of operation adaptable for use on the various parts of the human body having different curvatures, while maintaining the optimal blade geometry for smooth and effective shaving. This is done by having a rigid arcuate shaving blade cartridge, with fixed optimal blade geometry, and a rotatable means of connecting the cartridge to the handle, allowing the user to select the curvature most effective on different body parts.

Thus, the present invention contemplates a shaving system conforming to body contours, comprising an elongate handle bifurcated to form a yoke at one end, which yoke has two divergent arms formed to receive between them a razor blade cartridge. An elongate razor blade cartridge is permanently curved in an arc along its longitudinal axis. The cartridge has at least one shaving blade edge longitudinally disposed on each of convex and concave sides of the arc facing in opposite directions.

Rotatable connection means are operative between each of the handle yoke's arms and a corresponding end of the razor blade cartridge, for receiving, releasably engaging and rotatably supporting the cartridge transversely mounted between the handle yoke's arms in a user-selectable orientation.

The user-selectable orientation selectively disposes the convex or the concave sides of the cartridge, and at least one shaving blade edge of that side, towards the user's skin during use of the razor blade cartridge for shaving.

In one embodiment, the shaving system has a handle and a pair of arms formed from a resilient material. The end of each arm is bifurcated and sufficiently bendable so as to permit the insertion of the arcuate razor blade cartridge. That is, the bifurcation of the arms may be forcibly separated to allow mounting of the razor blade cartridge to the handle. Also, the resilient material handle is resiliently bendable to allow the razor blade cartridge to be rotated from the convex shaving position to the concave shaving position and vice versa.

Also contemplated in this invention is a handle and means to manually rotate the cartridge. The invention concerns a bifurcated, Y-shaped handle, forming a yoke at one end with two divergent arms having facilities to receive the ends of the cartridge at their distal ends. The cartridge is a rigid, arcuate elongate razor blade cartridge with at least one shaving blade edge disposed on each side of the arc to form a convex and a concave cutting edge. This cartridge is rotatably mounted transversely between the arms of the handle and has projections extending from each end along its longitudinal axis. The projections are pressed into recesses in the arms. A user simply rotates the cartridge 180° to select a convex or concave shaving surface.

In one embodiment, at least one of the projections extending from a cartridge end, and its corresponding receptacle are elliptical. In some cases, the user rotates the cartridge by turning a thumb wheel which is connected to the cartridge.

Additionally, an object of this invention is to provide a handle and means to remotely rotate the cartridge. This embodiment also comprises a bifurcated, Y-shaped, handle, forming a yoke at one end with two divergent hollow arms having recesses or rotating facilities at their distal ends with at least one of the rotating facilities having a small gear. The arms also rotatably receive a razor blade cartridge. There is a pushbutton member slidably disposed transversely within a bore in the handle below the yoke, and at least one longitudinally extending lever, pivotally mounted within a hollow arm of the yoke. This lever has a first end which engages the pushbutton member. The second end, distal to the pushbutton member, has a small segment of a large diameter gear that correctly meshes with the small gear at the end of the arm to engage and rotate the small gear thereby rotating the cartridge from a convex to a concave orientation or vice versa. There is also a detent means to maintain the pushbutton position and, thus, lock the cartridge in the selected orientation.

Movement of the pushbutton member causes rotational actuation of the lever means about an axis caused by one or more bearing blocks or bushings positioned within the hollow arm. The gear ratio is such that moving the pushbutton from one detent to the other causes a 180° rotation of the cartridge.

An associated object contemplated by this invention is a longitudinally arcuate razor blade cartridge assembly, comprising a rigid, longitudinally convex shoe member, wedge-shaped in cross-section, with a blade-supporting upper surface, and a rigid, longitudinally concave cap member, with a blade supporting undersurface and a wedge orientation opposite to that of the shoe member, the concave cap member overlaying the convex shoe member with the blade supporting surfaces facing each other.

At least one shaving blade is disposed between the shoe and cap member surfaces, the leading cutting edge of the blade extending past the intersecting point of the shoe wedge, the trailing cutting edge extending past the cap wedge point of intersection. Projections are formed to extend beyond the cartridge ends, and are of a complementary configuration to facilities located at distal ends of divergent arms of a handle to rotatably mount the cartridge to the handle. In one preferred embodiment, at least one of the projections extending beyond the cartridge end is a projection of elliptical cross-section.

In another embodiment of the cartridge, the inner surface longitudinal wall of the shoe member has a groove which forms a hood or guard over the leading edge of the shaving blade, providing the optimal blade to skin geometry for shaving. The lip of the hood has arcuate groves and ridges running longitudinally to provide a surface which aids in propping up the hairs for shaving.

The shaving blade configuration can also differ. One embodiment may use a single double-edged blade, while in another, the cutting surfaces comprise a plurality of doubleedged blades, mounted parallel over each other with a spacer therebetween. There could also be a plurality of razor blades, which could be single or double edged on either or both the convex or concave sides. In a particularly preferred embodiment, the cap, blade and shoe are permanently bonded.

DESCRIPTION OF THE PREFERRED EMBODIMENT

Figure 1A:
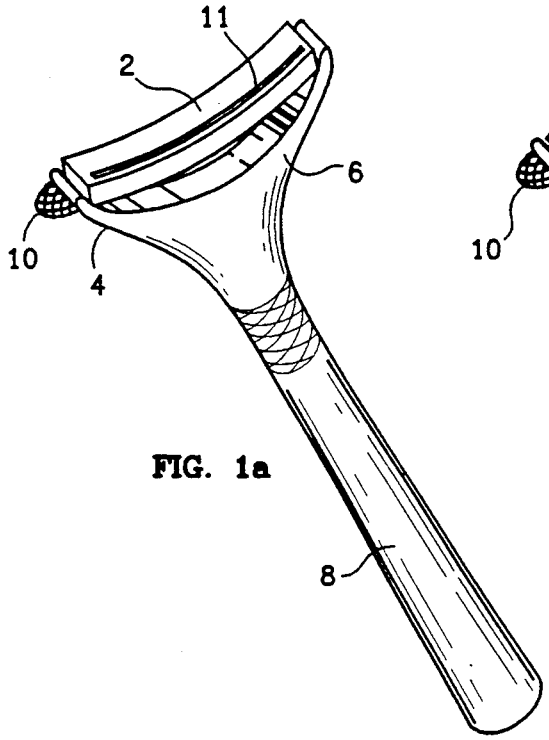
FIG. 1*a* is a perspective view of the convex, concave safety razor which is the subject of this invention having a rigid arcuate cartridge manually positioned in the concave mode.
Figure 1B:
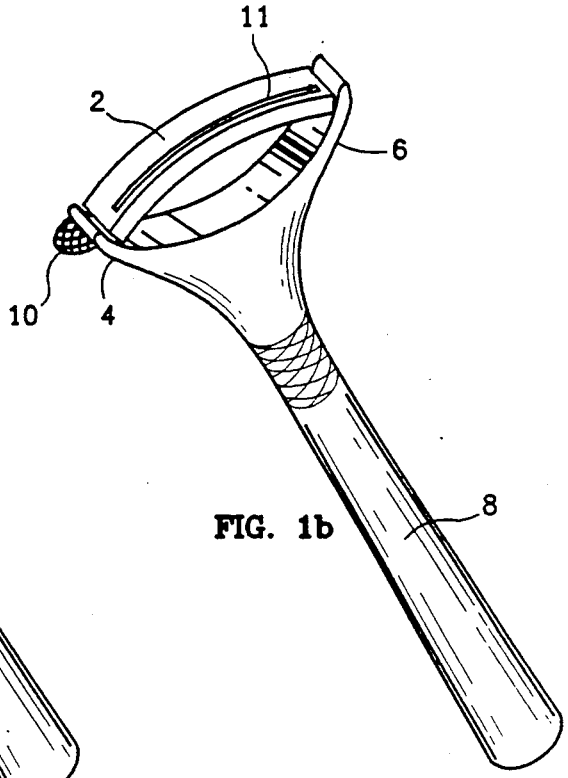
FIG. 1*b* likewise, is a perspective view of the safety razor of this invention, showing the cartridge in the convex position.

In accordance with the present invention, FIGS. 1*a* and 1*b* show one safety razor embodiment described in this invention, with a rigid arcuate shaped shaving blade cartridge 2 in concave and convex positions, respectively. The razor includes a handle 8 having a bifurcated end forming two arms 4 and 6. The arms and handle form a Y-shape. The arms 4 and 6 extend upwardly and outwardly to form a yoke to receive and rotatably hold a cartridge 2 in position. In one embodiment, the cartridge 2 is rotatably moved by means of a thumbwheel 10 attached to one end of the cartridge 2. A concave shaving blade having a cutting edge 11 and a convex shaving blade having a cutting edge 12 is positioned on the respective sides of the arcuate cartridge assembly.

Figure 2A:
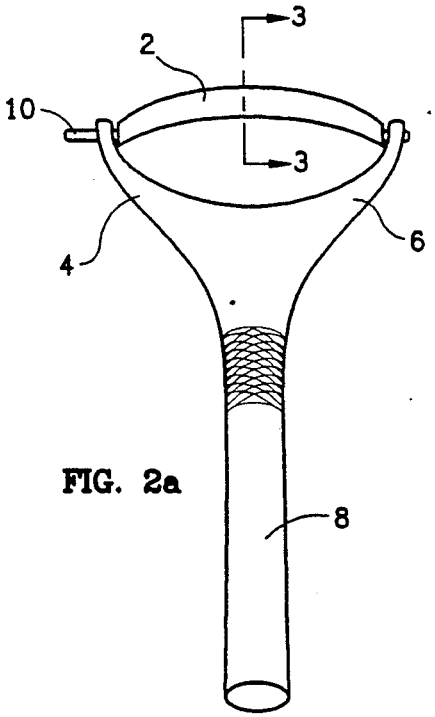
FIG. 2*a* is a side elevation view of the apparatus which is the subject of this invention with the cartridge in the convex mode.
Figure 2B:
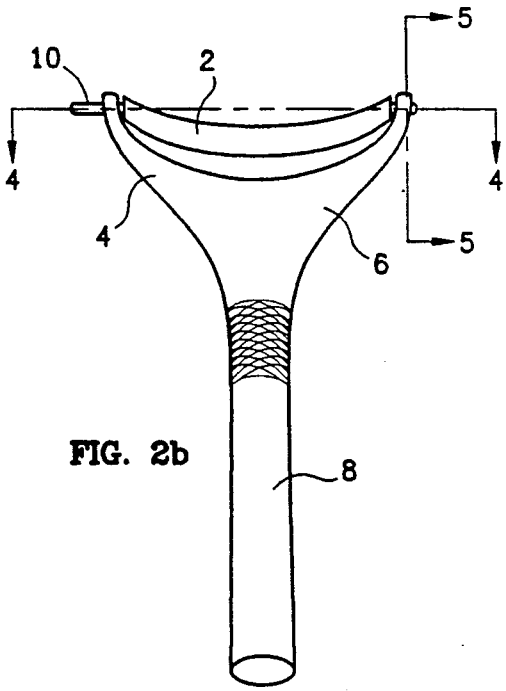
FIG. 2*b* is a side elevation view of the apparatus which is the subject of this invention with the cartridge in the concave mode.

FIGS. 2*a* and 2*b* are side elevation views of the same apparatus showing the cartridge 2 in the convex and concave modes, respectively, further depicting the relationship of the constituent parts of this invention.

Figure 3:
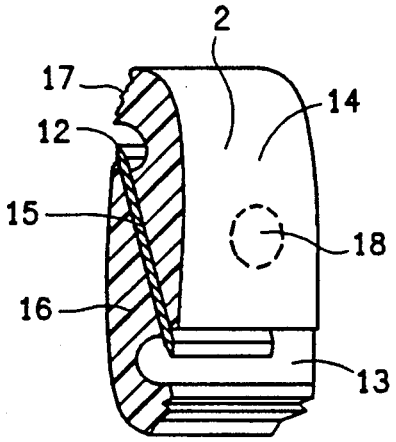
FIG. 3 is a perspective sectional view taken on line 3—3 of FIG. 2*a*.

In accordance with one aspect of the invention, FIG. 3 gives a perspective sectional view taken on line 3—3 of FIG. 2*b*, showing an arcuate concave shoe member 14, a convex cap member 16, and a double edged shaving blade 15 sandwiched therebetween. The leading edge 11 of the blade 15 which is the concave cutting edge, extends past the point of intersection of the wedge of the shoe member 14. The other edge 12 which is the convex cutting edge, extends past the semicircular groove 13 of the shoe 14. Conversely, the trailing edge 12 of the blade extending past the intersecting point of the wedge of the cap 16 becomes the leading edge when the cartridge is rotated to the convex position. A post 18 passes through the blade, drawing together the shoe and cap members and sandwiching the blade therebetween, and is either upset or coldheaded or otherwise bonded to form a rigid cartridge structural unit with a fixed blade geometry. Of course it is understood that any of many other modes of attachment may be used.

Figure 4:
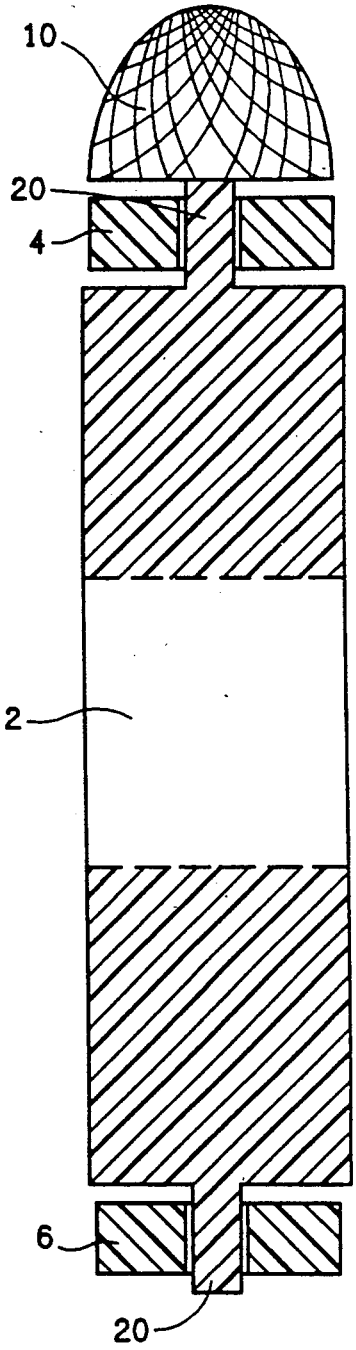
FIG. 4 is a sectional view taken on line 4—4 of FIG. 2*b*.

FIG. 4 is a top sectional view along line 4—4 of FIG. 2*a*, showing the arcuate cartridge 2, having end projections 20 which are elliptical in cross section positioned in the elliptical recesses 38 formed in a bifurcation 22 in each handle arm 4 and 6. The cartridge is rotated 180$^N$ by turning the thumbwheel 10 formed on one end of the cartridge 2 to go from a concave to a convex position, or vice versa. While the cartridge is described as having projections on the ends thereof which fit into recesses, it is apparent that the end of the cartridge could have recesses formed therein which cooperate with projections formed on the arms.

Figure 5:
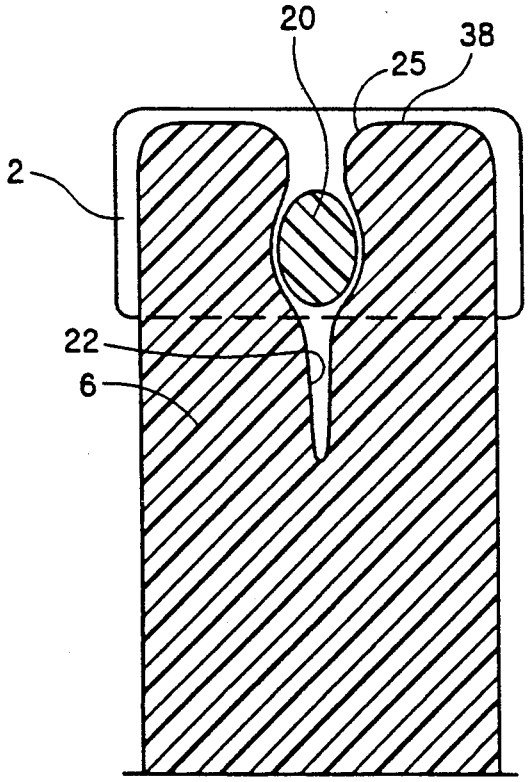
FIG. 5 is a sectional view taken on line 5—5 of FIG. 2*b*.

FIG. 5 is a sectional view taken along line 5—5 of FIG. 2*b*. The projections 20 of the cartridge 2 are inserted into the arms 4 and 6 of the handle 8 through narrow passages 25 into the elliptical recesses 38. The handle 8 is constructed from a resilient material, which allows the passages 25 and bifurcation 22 of each arm 4 and 6 to spread open to accept a cartridge elliptical projection 20. The resilient reaction clamps the bifurcated ends of the arms around the elliptical projection 20 after insertion and also serves as the detent for positioning the cartridge in either the convex or concave mode.

Figure 7:
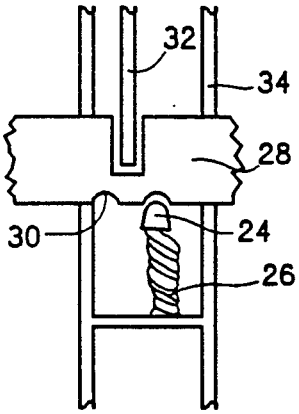
FIG. 7 is a view taken on line 7—7 of FIG. 6.
Figure 6:
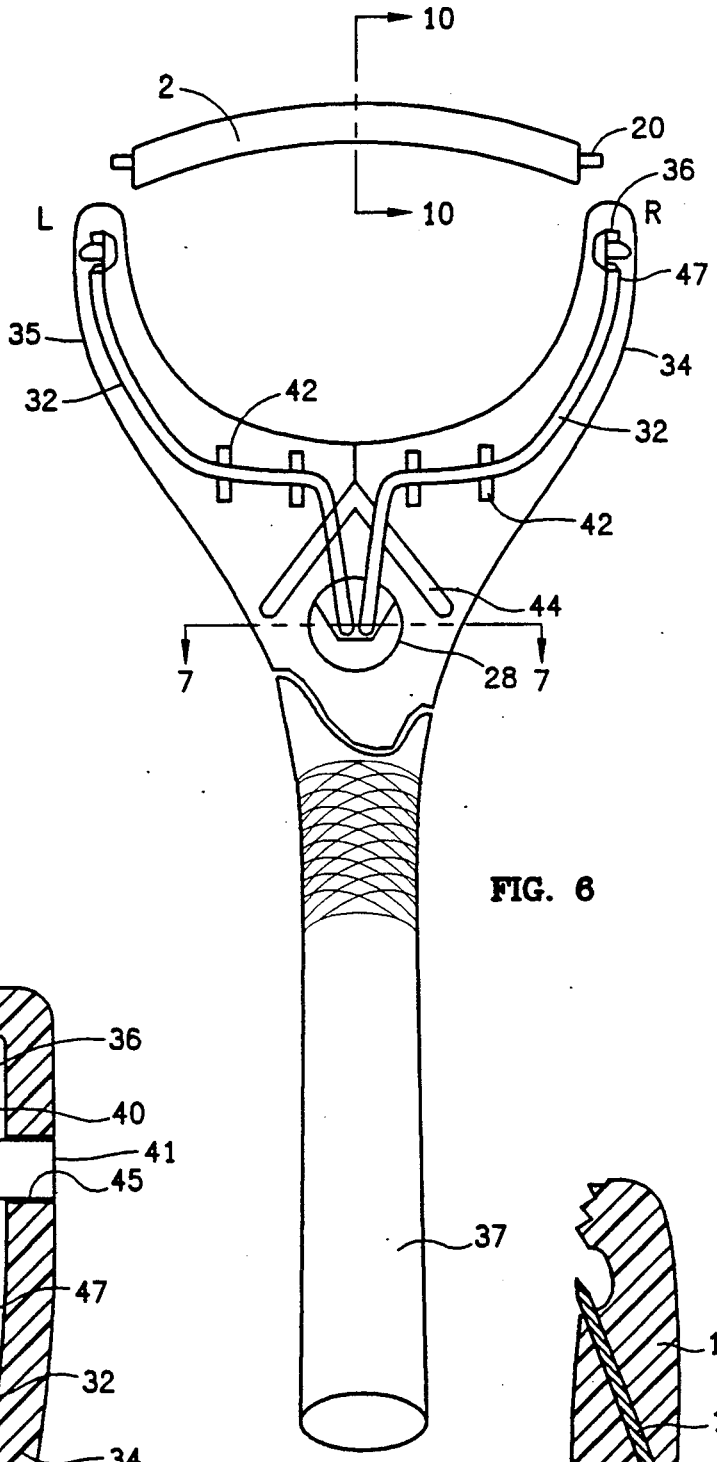
FIG. 6 is a plan View, partially cut away, of the remote actuation system, showing the cooperation of pushbutton, bearing blocks, levers and gears.
Figure 8:
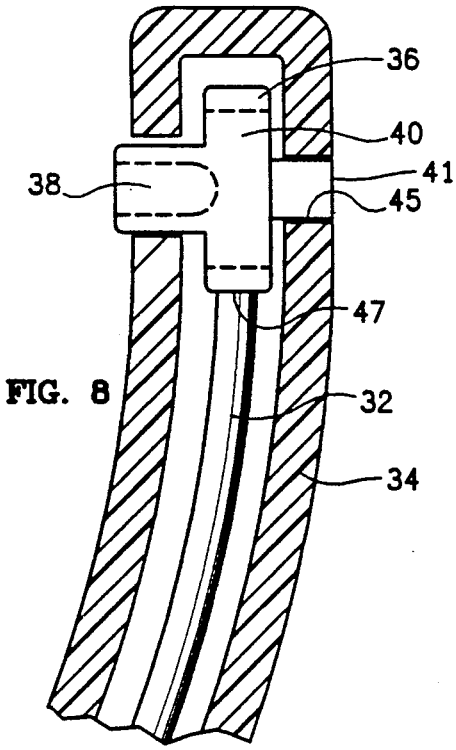
FIG. 8 is an enlarged view of the end of a yoke arm showing the cartridge rotating means.

Referring now to FIGS. 6, 7 and 8, a new embodiment is presented, showing the remote actuation mechanism by which a cartridge 2 can be rotated. The cartridge 2 has elliptical projections 20, which fit into rotatable members in the ends of the arms 34 and 35 of the handle 37. Depressing a pushbutton 28 in the handle 37 causes rotational movement of a pair of levers 32 about their axis of rotation in the bearing blocks 42 resulting in a reverse movement of the other end of the levers, each of which contains a small gear segment 47 of a large diameter gear as shown more clearly in FIG. 11. This slight movement of gear 47 causes a 180° rotation of gear 36 formed on rotatable member 40, with a corresponding 180° rotation of the cartridge 2.

FIG. 7 is a sectional side view taken along line 7—7 of FIG. 6, showing in detail the pushbutton mechanism that actuates the cartridge rotation. As can be seen, the pushbutton is held in position by means of a spring-loaded detent mechanism 24, 26 and 30.

The facilities for holding the cartridge 2 for this embodiment is depicted in FIG. 8, which is an enlarged sectional view of the end of the arm 34. The arm 34 has an opening containing a rotatable member 40, which has one end having an elliptical recess 38 formed therein into which the projection 20 of one end of the cartridge 2 is fitted. The other end of rotatable member 40 has a projecting shaft 41 which extends through a bore 45 in the arm 34. The rotatable member 40 has gear teeth 36 formed around the outer periphery of the central portion between the recess 38 and the shaft 41.

Figure 9:
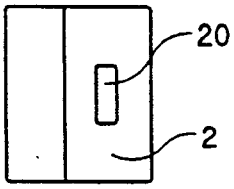
FIG. 9 is an end view of a cartridge showing the elliptical projection.
Figure 10:
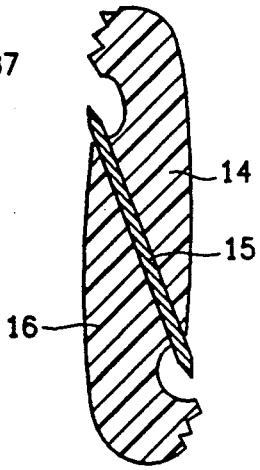
FIG. 10 is a sectional view taken on line 10—10 of FIG. 7.

FIG. 9 is an end view of a cartridge 2 illustrating the elliptical cross-section of projection 20 which fits into the recess 38 of rotatable member 40 shown in FIG. 8. A cross-sectional view of the cartridge 2 is shown in FIG. 10. Sandwiched between a shoe 14 and a cap 16 is a single doubleedged blade 15. Other features were described with reference to FIG. 3.

Figure 11:
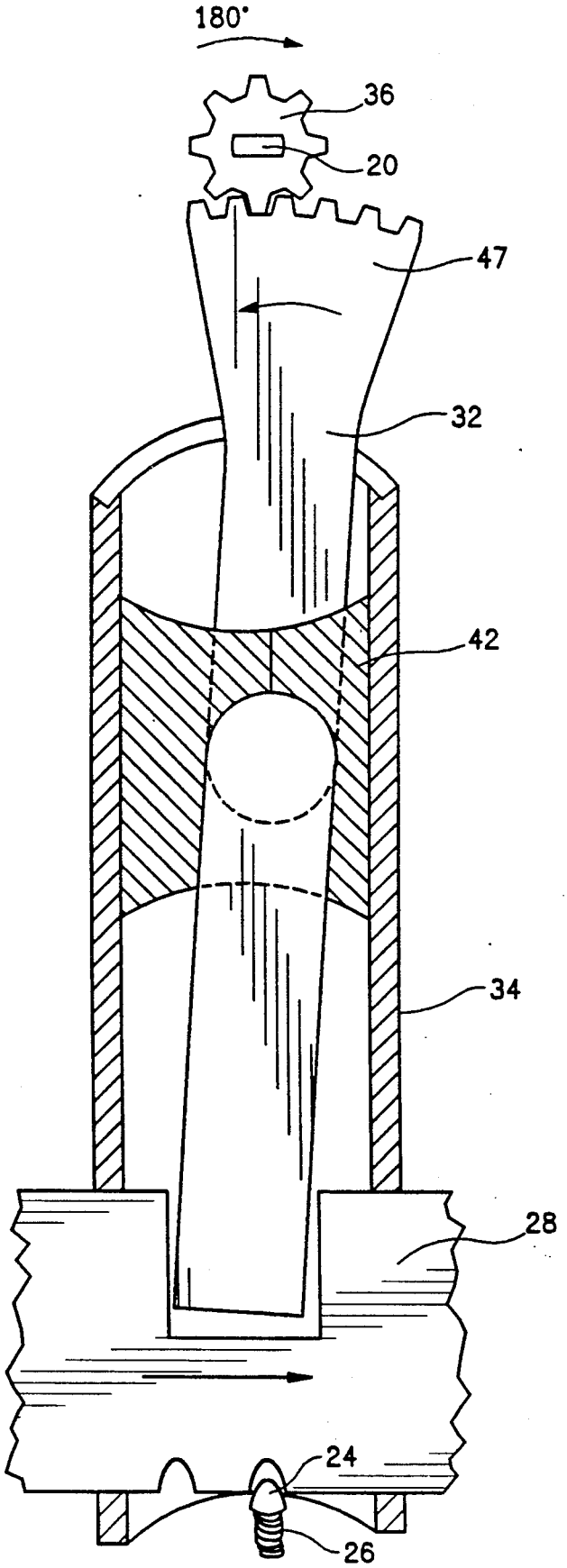
FIG. 11 is an enlarged schematic representation of the pushbutton remote actuation mechanism.

FIG. 11 is an enlarged schematic representation of the remote actuation mechanism described above, showing how a slight movement of the pushbutton 28 causes a 180° rotation of the gear 36 and the cartridge 2. The gear ratio is such that, for example, movement of the small segment of the large diameter gear 47 through about 5 gear teeth causes a half turn of the small gear 36, and a corresponding 180° rotation of the elliptical projection 20 and consequently the cartridge 2.

While the pushbutton, lever and gear arrangement have been described above, those skilled in the art will appreciate that there are numerous other ways to cause rotation of the cartridge to position it in either its convex or concave shaving position.

Figure 12:
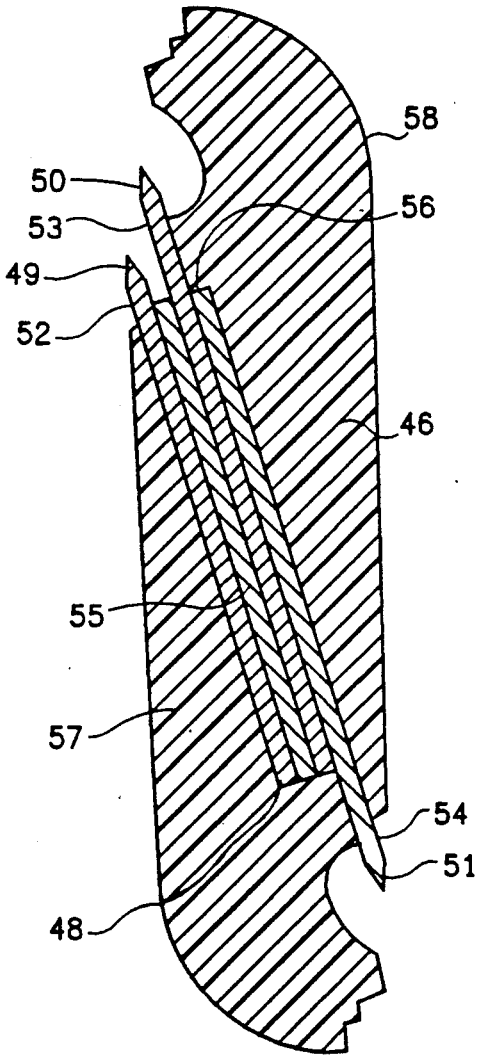
FIG. 12 is a sectional view of an optional blade configuration.

An optional blade configuration is shown in FIG. 12. This view shows a cartridge 46 with two cutting edges 49 and 50 on the concave surface, and one cutting edge 51 on the convex surface. It can be seen that none of the blades are double-edged in this case. The cutting edges are provided by three single blades 52, 53 and 54, of which blades 52 and 53 are separated by a spacer 55. The rear edge of blades 52 and 53 are positioned against an abutment 48 formed in shoe 57. The rear edge of blade 54 is positioned against an abutment 56 formed in cap 58.

Figure 13:
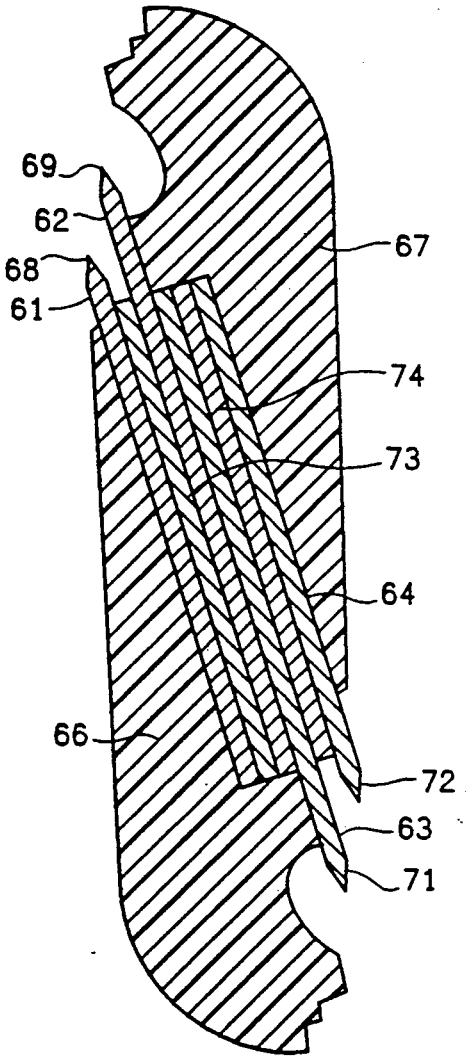
FIG. 13 is a sectional view of another optional blade configuration.

Another optional blade configuration is shown in FIG. 13. Here, four single-edged blades 61, 62, 63 and 64 are sandwiched between a shoe 66 and cap 67, providing two cutting edges 68 and 69 on one side and two cutting edges 71 and 72 on the other side. Blades 61 and 62 are separated by a spacer 73, and blades 63 and 64 are separated by a spacer 74. Consequently, cartridges may be provided that are single edged on each side, double edged on each side or any combination of single and double edged as desired. Further, while the cartridges are shown having elliptically shaped projections to hold the cartridges in the arms, numerous other arrangements are possible for mounting the cartridge to the arms and allowing rotation relative thereto.

Figure 14:
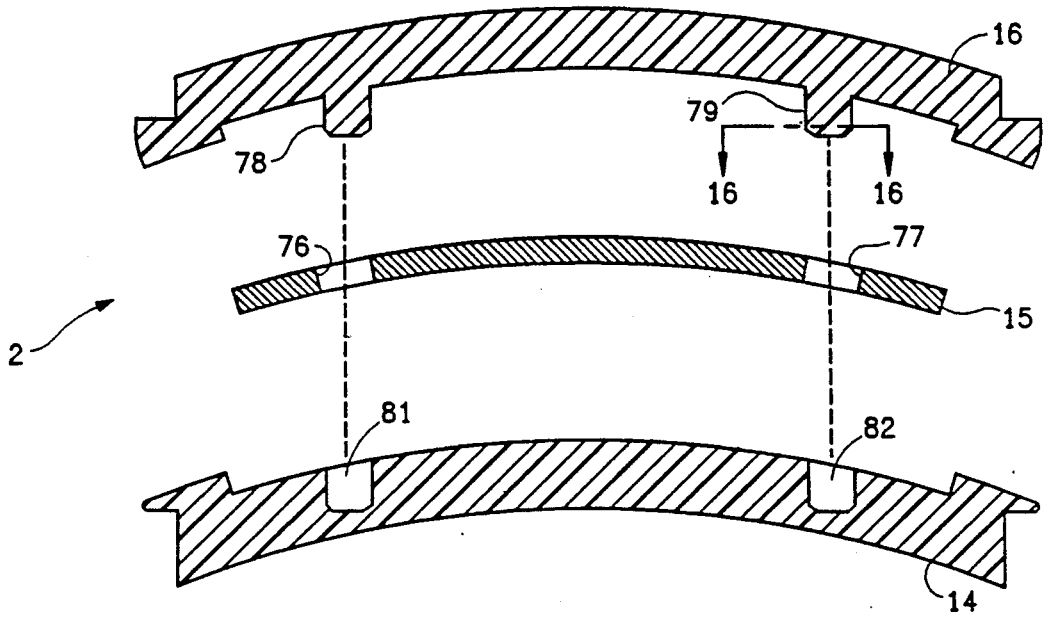
FIG. 14 is a cross-sectional exploded view of a cartridge assembly.
Figure 15:
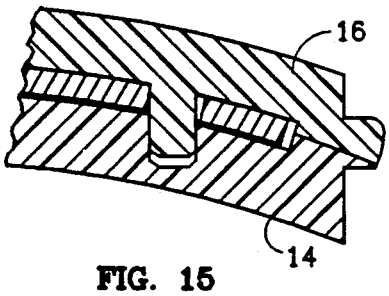
FIG. 15 is a partial cross-sectional view of an assembled cartridge assembly.
Figure 16:
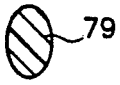
FIG. 16 is a cross-sectional view taken along line 16—16 of FIG. 14.

Referring now to FIGS. 14, 15 and 16, the cartridge assembly 2 is shown in exploded and assembled views. The cartridge assembly includes a cap 16, shoe 14 and blade 15. The cartridge uses a conventional flat blade with standard hole configuration. The blade 15 is formed from a flat sheet and has two round holes 76 and 77 formed therein. Cap 16 has posts 78 and 79 formed therein which pass through holes 76 and 77 and into recesses 81 and 82 formed in the shoe 14. When the blade is bent into the arcuate shape of the cap 16 and shoe 14, the holes have an elliptical cross-section. In order to mount the blade so that it does not move within the cartridge assembly either longitudinally or transversely, the posts 78 and 79 must contact the edges of the holes 76 and 77 as shown in FIG. 15. The posts are formed to have an elliptical cross-section as shown in FIG. 16 with the major axis being transverse to the longitudinal axis of the cartridge and being equal to the diameter of the holes 76 and 77, and the minor axis being parallel to the longitudinal axis of the cartridge and being smaller than the diameter of the holes 76 and 77. Upon bonding the cap 16 and shoe 14 together with the blade 15 therebetween, the blade is rigidly held in its arcuate shape. The preferred arcuate shape is an arc having a radius of from 1 inch to 5 inches.

Although the present invention has now been described in terms of certain preferred embodiments, and exemplified with respect thereto, one skilled in the art will readily appreciate that various modifications, changes, omissions and substitutions may be made without departing from the spirit thereof. It is intended, therefore, that the present invention be limited solely by the scope of the following claims.

We claim:

1. A shaving system comprising:

a razor blade cartridge curved in a fixed arcuate shape having a concave cutting edge on one side thereof facing in a first direction and a convex cutting edge on the other side thereof facing in a second direction opposite to the first direction and a thumb wheel at one and thereof;

a handle; and means mounted to said handle for rotatably receiving each end of said cartridge and for selectively positioning the concave cutting edge in a first fixed shaving position and the convex cutting edge in a second fixed shaving position.

2. The shaving system according to claim 1 wherein said cartridge is curved in an arc having an arc radius of from one inch to five inches.

3. The shaving system according to claim 1 wherein said cartridge includes projections on each end thereof and one of said projections includes said thumb wheel, and said handle includes a pair of arms, said means for rotatably receiving each end of said cartridge being positioned at the ends of said arms and including recesses therein for receiving said projections of said cartridge.

4. The shaving system according to claim 3 wherein said projections and the corresponding recesses are elliptical in cross section.

5. A shaving system comprising:

a safety razor blade cartridge formed in an arcuate shape about its longitudinal axis, the cartridge having a first cutting edge on one side thereof fixed in a convex arcuate shape and a second cutting edge on the other side thereof fixed in a concave arcuate shape, the end of the cartridge having projections formed thereon and having a thumb wheel at one end;

an elongated handle having a pair of spaced apart arms at one end thereof; and means on said arms for rotatably receiving the projections of said ends of said cartridge, for mounting said cartridge to said arms and for locking said cartridge in either a first predetermined position wherein said convex cutting edge is operative or a second predetermined position wherein said concave cutting edge is operative.

6. The shaving system in accordance with claim 5 wherein the ends of the arms are bifurcated and the handle is made of a resilient material sufficiently bendable so as to permit the insertion of the projections of said razor blade cartridge between the bifurcation of each arm.

7. A shaving system having a rotatable arcuate razor blade cartridge to optimize shaving body contours, comprising:

a Y-shaped handle forming a yoke at one end with two divergent arms having recesses at their digital ends for receiving a razor blade cartridge;

a rigid, arcuate razor blade cartridge with at least one shaving blade having cutting edges disposed in opposite directions on each of the convex and concave sides of the arc, said cartridge having projections extending from each end thereof which rotatably mount in the recesses of said arms, having a thumb wheel at one end thereof; and means for locking said cartridge in either of two operative positions wherein a user rotates the cartridge 180° to select either the convex or concave shaving surface.

8. The shaving system in accordance with claim 7, wherein at least one of the projections extending from a cartridge end and its corresponding recess are elliptical in cross-section.

9. A shaving system having a rotatable razor blade cartridge with convex and concave blades comprising:

a Y-shaped handle forming a yoke at one end with two divergent hollow arms;

rotatable means mounted to the end of each arm for rotatably receiving an end of a razor blade cartridge;

a rigid, arcuate razor blade cartridge with at least one shaving blade edge disposed on each side of the arc facing in opposite directions, said cartridge having projections extending from each end of the cartridge along its longitudinal axis, the projections engaging said rotatable means for rotatably mounting the cartridge transversely between the arms of the handle; and remote cartridge actuation means mounted in said handle for rotating said cartridge when activated by a user.

10. The shaving system of claim 9 wherein the rotatable means further includes a gear formed about its periphery and the remote cartridge actuation means includes a pushbutton member slidably disposed transversely within a bore in the handle below the yoke, at least one lever, pivotally mounted within a hollow arm of the yoke, having a first end which engages the pushbutton member, and a second end which engages the gear of said rotatable means, said second end having a segment of a large diameter gear that correctly meshes with the rotatable means gear to engage and rotate the rotatable means gear 180°, thereby positioning either the convex or concave blade edge in shaving position, and a detent means to maintain the pushbutton position and the selected cartridge orientation, wherein sliding the pushbutton member causes movement of the lever and gears to rotate the cartridge 180°.

11. The shaving system in accordance with claim 10 wherein the cartridge includes a plurality of blades to form double concave cutting edges and double convex cutting edges.

12. The shaving system in accordance with claim 9 wherein said cartridge is curved in an arc having an arc radius of from one inch to five inches.

13. A razor blade cartridge assembly comprising:

a rigid cap member formed in an arc along its longitudinal axis;

a rigid shoe member formed in an arc along its longitudinal axis complementary to the arc of the cap member;

blade means having at least two opposed cutting edges sandwiched between said shoe member and said cap member, said blade means being curved into an arcuate shape along its longitudinal axis and having one of said cutting edges being operative to shave when one cutting edge of the blade is held in a concave position relative to a shaver and the other of said cutting edges being operative to shave when the blade means is rotated and held in a convex position relative to a shaver, said cap member and said shoe member being bonded together to form a cartridge assembly; and means formed on both ends of said cartridge assembly for cooperating with rotating connection means of a razor whereby said cartridge may be selectively rotated by a user into either a fixed convex or concave shaving position.

14. The razor blade cartridge assembly in accordance with claim 13 wherein said blade means includes a plurality of blades having one or more spacers therebetween to form double cutting edges on the concave side of said cartridge assembly and double cutting edges on the convex side of said cartridge assembly.

15. A razor blade cartridge assembly, comprising:

a rigid, longitudinally convex shoe member, wedge-shaped in cross section, with a blade-supporting surface;

a rigid, longitudinally concave cap member, wedge shaped in cross-section, with a blade supporting surface opposite to that of the shoe member, the concave cap member overlaying the convex shoe member with the blade supporting surfaces facing each other;

at least one shaving blade disposed between the shoe and cap member, the leading cutting edge of the blade extending past the point of the shoe wedge, the trailing cutting edge extending past the point of the cap wedge; and projections formed on the ends of the cap and shoe members, the projections adapted to cooperate with a complementary configuration formed on the handle of a razor to receive said cartridge and to position said cartridge in either a first fixed shaving position wherein the cartridge assembly is in a concave relationship to a shaving surface or a second fixed shaving position wherein said cartridge assembly is in a convex relationship to a shaving surface.

16. The cartridge assembly in accordance with claim 15, wherein at least one of the projections has an elliptical cross-section.

17. The cartridge assembly in accordance with claim 15, wherein the blade supporting surface of both the shoe member and the cap member has a groove which forms a guard over the corresponding edge of the shaving blade, providing the optimal blade to skin geometry for shaving.

18. The cartridge assembly in accordance with claim 17, wherein the guard has a plurality of grooves and ridges running longitudinally to provide a surface which aids in propping up the hairs for shaving.

19. The cartridge assembly in accordance with claim 15, wherein the cutting surfaces comprise:

a single double-edged blade.

20. The cartridge assembly in accordance with claim 15, wherein the cutting surfaces comprise:

a single edged blade and a double-edged blade, mounted parallel to and spaced apart from each other.

21. The cartridge assembly in accordance with claim 15, wherein the cutting surfaces comprise:

a plurality of double-edged blades, mounted parallel to each other with a spacer therebetween.

22. The cartridge assembly in accordance with claim 15, wherein the cutting surfaces comprise:

a plurality of razor blades, any number of which may be single-edged and prevented from moving backward by an abutment on the blade-supporting flat surface.

23. The cartridge assembly in accordance with claim 15, wherein the cap, blade and shoe are permanently bonded together.

24. The cartridge assembly in accordance with claim 15 wherein the cap member has a plurality of posts extending from the blade supporting surface, the shoe member has a plurality of recesses formed in the blade supporting surface to receive the posts and the blade has holes for receiving the posts.

25. The cartridge assembly in accordance with claim 24 wherein the posts are elliptical in cross-section.

26. The cartridge assembly in accordance with claim 25 wherein the major axis of the elliptical cross-section equals the diameter of the holes in the blade and the minor axis is smaller than the diameter of the holes in the blade.

* * * * *